US008531373B2

(12) United States Patent
Dembo

(10) Patent No.: US 8,531,373 B2
(45) Date of Patent: Sep. 10, 2013

(54) LIQUID CRYSTAL DISPLAY DEVICE AND IMAGE DISPLAY METHOD OF THE SAME

(75) Inventor: Hiroki Dembo, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 979 days.

(21) Appl. No.: 12/273,266

(22) Filed: Nov. 18, 2008

(65) Prior Publication Data

US 2009/0128478 A1 May 21, 2009

(30) Foreign Application Priority Data

Nov. 20, 2007 (JP) ..... 2007-300097

(51) Int. Cl.
*G09G 3/36* (2006.01)

(52) U.S. Cl.
USPC ..... 345/98; 345/690

(58) Field of Classification Search
USPC ..... 345/87–102, 690, 204
See application file for complete search history.

(56) References Cited

U.S. PATENT DOCUMENTS

| | | | | |
|---|---|---|---|---|
| 6,392,620 | B1 | 5/2002 | Mizutani et al. | |
| 6,614,415 | B2 | 9/2003 | Mizutani et al. | |
| 6,836,293 | B2 | 12/2004 | Itoh et al. | |
| 6,876,367 | B2 * | 4/2005 | Wada et al. | 345/690 |
| 7,142,203 | B2 | 11/2006 | Hiroki et al. | |
| 7,256,836 | B2 | 8/2007 | Itoh et al. | |
| 7,418,150 | B2 | 8/2008 | Myoga | |
| 2002/0015104 | A1 | 2/2002 | Itoh et al. | |
| 2003/0058229 | A1 | 3/2003 | Kawabe et al. | |
| 2005/0200619 | A1 | 9/2005 | Adachi et al. | |
| 2006/0044472 | A1 | 3/2006 | Lee et al. | |
| 2006/0092164 | A1 | 5/2006 | Takeuchi et al. | |
| 2006/0279478 | A1 | 12/2006 | Ikegami | |
| 2007/0008334 | A1 | 1/2007 | Takeuchi | |
| 2007/0040823 | A1 | 2/2007 | Hiroki et al. | |
| 2007/0103585 | A1 | 5/2007 | Takeuchi et al. | |

(Continued)

FOREIGN PATENT DOCUMENTS

| | | |
|---|---|---|
| EP | 1 653 438 | 5/2006 |
| JP | 04-302289 | 10/1992 |

(Continued)

OTHER PUBLICATIONS

International Search Report (International Application No. PCT/JP2008/070535), dated Dec. 16, 2008; 3 pages.

(Continued)

*Primary Examiner* — Kevin M Nguyen
*Assistant Examiner* — Sepideh Ghafari
(74) *Attorney, Agent, or Firm* — Fish & Richardson P.C.

(57) ABSTRACT

To provide a liquid crystal display device which performs pseudo impulsive driving, ensures brightness of a screen, and can improve the contrast of the screen. An arithmetic device for generating insertion images is provided in a liquid crystal display device for realizing pseudo impulsive driving. A moving object region and a background region are extracted from first image data which is input to the arithmetic device; second image data where the moving object region is displayed as a black image or a white image is generated; and a display panel performs display where the second image data of $n^{th}$ frame is displayed as an insertion image in a period between the first image data of $n^{th}$ frame and the first image data of $(n+1)^{th}$ frame.

25 Claims, 14 Drawing Sheets

(56) References Cited

U.S. PATENT DOCUMENTS

| | | | | |
|---|---|---|---|---|
| 2007/0230569 | A1 | 10/2007 | Itoh et al. | |
| 2007/0236603 | A1 | 10/2007 | Itoh et al. | |
| 2008/0068359 | A1 * | 3/2008 | Yoshida et al. | 345/204 |
| 2008/0079852 | A1 | 4/2008 | Nagaishi et al. | |

FOREIGN PATENT DOCUMENTS

| | | | |
|---|---|---|---|
| JP | 08-036145 | | 2/1996 |
| JP | 08-340556 | | 12/1996 |
| JP | 09-204159 | | 8/1997 |
| JP | 10-111491 | | 4/1998 |
| JP | 10-233919 | | 9/1998 |
| JP | 2000-200063 | | 7/2000 |
| JP | 2001-222264 | | 8/2001 |
| JP | 2001-296841 | | 10/2001 |
| JP | 2002-006818 | | 1/2002 |
| JP | 2002171424 | A | 6/2002 |
| JP | 2003186454 | A | 7/2003 |
| JP | 2005-229198 | | 8/2005 |
| JP | 2005-277916 | | 10/2005 |
| JP | 2006072359 | A | 3/2006 |
| JP | 2006-133384 | | 5/2006 |
| JP | 2006-154751 | | 6/2006 |
| JP | 2007017936 | A | 1/2007 |
| JP | 2007-129526 | | 5/2007 |
| JP | 2008-089958 | | 4/2008 |
| WO | 2007/072598 | | 6/2007 |

OTHER PUBLICATIONS

Written Opinion (International Application No. PCT/JP2008/070535), dated Dec. 16, 2008; 3 pages.

European Office Action (Application No. 08852100.0) dated Oct. 7, 2011, in English.

European Search Report (European Application No. 08852100.0) mailed Mar. 9, 2011.

* cited by examiner

LIQUID CRYSTAL DISPLAY DEVICE AND IMAGE DISPLAY METHOD OF THE SAME

TECHNICAL FIELD

The present invention relates to a liquid crystal display device and an image display method thereof. In particular, the present invention relates to a liquid crystal display device which can improve the image quality of moving images to be displayed and an image display method thereof.

BACKGROUND ART

Liquid crystal display devices for obtaining high image quality have been developed. In obtaining high image quality in liquid crystal display devices, problems in that ghost edges are generated and that motion appears unnatural due to response time of liquid crystals at the time of displaying moving images are inevitable because of characteristics of liquid crystals, which are display elements.

Display devices using impulsive driving, such as cathode ray tube (CRT) display devices, do not have the problems in that ghost edges are generated and that motion appears unnatural due to response time of liquid crystals. Therefore, in order to solve such problems unique to liquid crystal display devices, a method for realizing pseudo impulsive driving by displaying a black image in which nothing is displayed for a certain period in one frame period is disclosed (for example, Reference 1: Japanese Published Patent Application No. 2000-200063).

DISCLOSURE OF INVENTION

However, a liquid crystal display device performing black frame insertion, which is disclosed in Reference 1, has problems in that it is difficult to ensure brightness of the entire screen and that the contrast of the screen is decreased.

In view of the foregoing problems, the present invention provides a liquid crystal display device which performs pseudo impulsive driving, ensures brightness of a screen, and can improve the contrast of the screen, and a driving method thereof.

In order to solve the aforementioned problems, in the present invention, an arithmetic device for generating insertion images is provided in a liquid crystal display device for realizing pseudo impulsive driving. A moving object region and a background region are extracted from first image data which is input to the arithmetic device; second image data where the moving object region is displayed as a black image or a white image is generated; and the first image data and the second image data are alternately output to a display panel in each frame.

In accordance with one aspect of the present invention, a liquid crystal display device includes a display panel having a plurality of pixels and an arithmetic device for generating second image data based on first image data which is to be input. The arithmetic device extracts a moving object region and a background region displayed on the display panel from the first image data and generates the second image data where the moving object region is displayed as a black image. The first image data and the second image data are alternately output to the display panel in each frame.

In accordance with another aspect of the present invention, a liquid crystal display device includes a display panel having a plurality of pixels and an arithmetic device for generating second image data based on first image data which is to be input. The arithmetic device extracts a moving object region and a background region displayed on the display panel from the first image data and generates the second image data where the moving object region is displayed as a white image. The first image data and the second image data are alternately output to the display panel in each frame.

In accordance with another aspect of the present invention, a liquid crystal display device includes a display panel having a plurality of pixels and an arithmetic device for generating second image data based on first image data which is to be input. The arithmetic device includes a first memory circuit portion for storing the first image data in frame, a central processing unit for extracting a moving object region and a background region displayed on the display panel from the first image data and generating the second image data where the moving object region is displayed as a black image, and a second memory circuit portion for storing the second image data in frame. The first image data and the second image data are alternately output to the display panel in each frame.

In accordance with another aspect of the present invention, a liquid crystal display device includes a display panel having a plurality of pixels and an arithmetic device for generating second image data based on first image data which is to be input. The arithmetic device includes a first memory circuit portion for storing the first image data in frame, a central processing unit for extracting a moving object region and a background region displayed on the display panel from the first image data and generating the second image data where the moving object region is displayed as a white image, and a second memory circuit portion for storing the second image data in frame. The first image data and the second image data are alternately output to the display panel in each frame.

In accordance with another aspect of the present invention, a liquid crystal display device includes a display panel having a plurality of pixels and an arithmetic device for generating second image data based on first image data which is to be input. The arithmetic device includes a first memory circuit portion for storing the first image data in frame, a central processing unit for extracting a moving object region and a background region displayed on the display panel from the first image data and generating the second image data where the moving object region is displayed as a black image, a second memory circuit portion for storing the second image data in frame, a writing control circuit for controlling writing of the first image data to the first memory circuit portion and writing of the second image data to the second memory circuit portion, and a reading control circuit for controlling reading of the first image data from the first memory circuit portion and reading of the second image data from the second memory circuit portion. The first image data and the second image data are alternately output to the display panel in each frame.

In accordance with another aspect of the present invention, a liquid crystal display device includes a display panel having a plurality of pixels and an arithmetic device for generating second image data based on first image data which is to be input. The arithmetic device includes a first memory circuit portion for storing the first image data in frame, a central processing unit for extracting a moving object region and a background region displayed on the display panel from the first image data and generating the second image data where the moving object region is displayed as a white image, a second memory circuit portion for storing the second image data in frame, a writing control circuit for controlling writing of the first image data to the first memory circuit portion and writing of the second image data to the second memory circuit portion, and a reading control circuit for controlling reading of the first image data from the first memory circuit portion and reading of the second image data from the second memory circuit portion. The first image data and the second image data are alternately output to the display panel in each frame.

In accordance with another aspect of the present invention, an image display method of a liquid crystal display device for displaying a moving image on a display panel having a plurality of pixels includes the following steps: extracting a moving object region and a background region displayed on the display panel from first image data input to an arithmetic device, generating second image data where the moving object region is displayed as a black image, and displaying the first image data and the second image data alternately on the display panel in each frame.

In accordance with another aspect of the present invention, an image display method of a liquid crystal display device for displaying a moving image on a display panel having a plurality of pixels includes the following steps: extracting a moving object region and a background region displayed on the display panel from first image data input to an arithmetic device, generating second image data where the moving object region is displayed as a white image, and displaying the first image data and the second image data alternately on the display panel in each frame.

Further, in the present invention, the frame rate of the first image data and the second image data displayed alternately on the display panel in each frame is higher than the frame rate of the first image data.

According to the present invention, it is possible to provide a liquid crystal display device which can perform pseudo impulsive driving, ensures brightness of a screen, and improves the contrast of the screen.

BEST MODE FOR CARRYING OUT THE INVENTION

Figure 1:
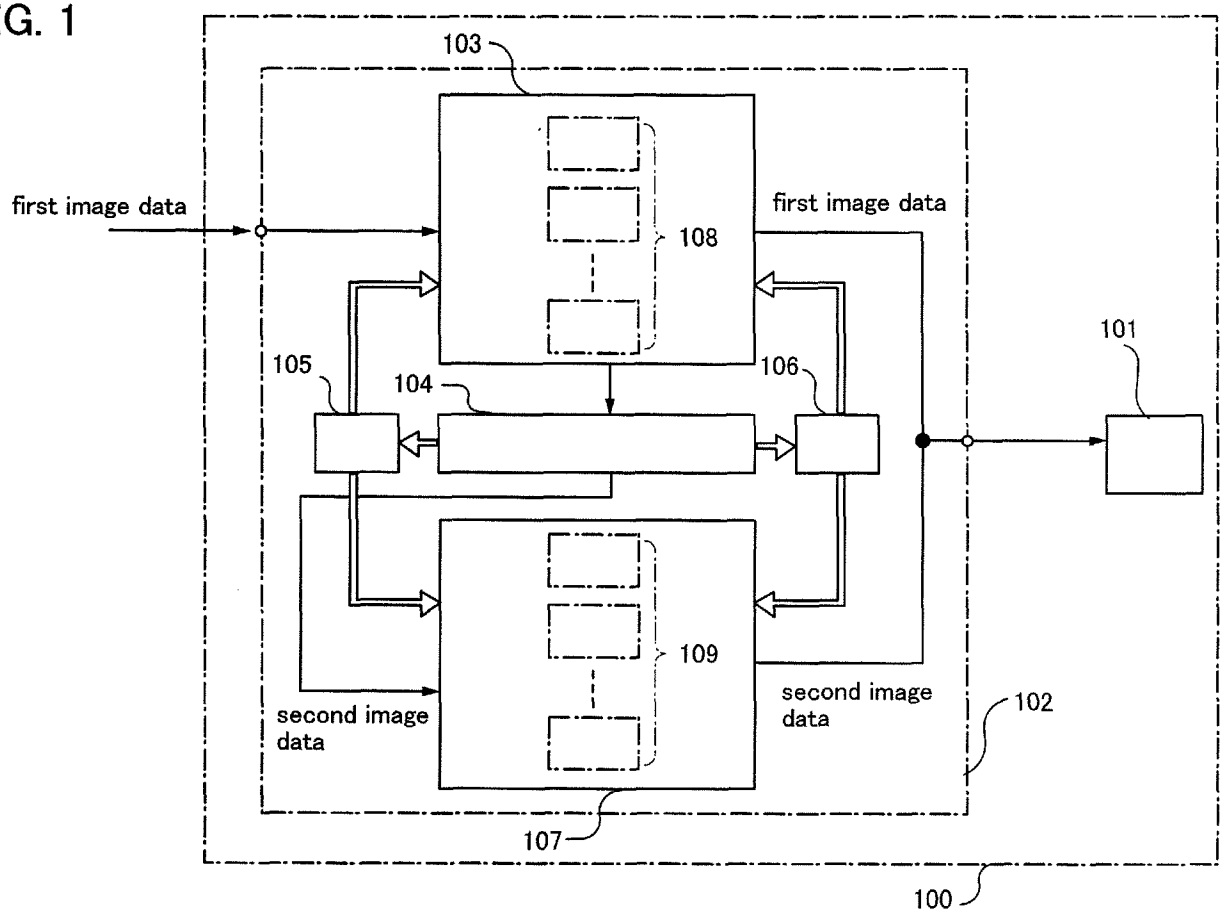
FIG. 1 is a block diagram illustrating Embodiment Mode 1 of the present invention.

Hereinafter, embodiment modes of the present invention will be described with reference to the drawings. Note that the present invention can be implemented in various different ways and it will be readily appreciated by those skilled in the art that various changes and modifications are possible without departing from the spirit and the scope of the present invention. Therefore, the present invention should not be construed as being limited to the following description of the embodiment modes. Note that in all the drawings for describing the embodiment modes, like portions or portions having similar functions are denoted by the same reference numerals, and description thereof is not repeated.

Embodiment Mode 1

FIG. 1 is a block diagram showing a liquid crystal display device of the present invention. A liquid crystal display device 100 includes a display panel 101 and an arithmetic device 102. The arithmetic device 102 includes a first memory circuit portion 103, a central processing unit 104, a writing control circuit 105, a reading control circuit 106, and a second memory circuit portion 107.

The arithmetic device 102 shown in FIG. 1 is described. In the arithmetic device 102 shown in FIG. 1, first image data is supplied from the outside, and the first image data of each frame is stored in a plurality of memories 108 included in the first memory circuit portion 103. Note that storing of the first image data is performed by providing a selector (not shown) for storing the first image data in each frame in the plurality of memories 108 and controlling with the writing control circuit 105.

Note that in this specification, terms such as "first", "second", "third", and "$N^{th}$" (N is a natural number) are used in order to avoid confusion among components, and the terms do not limit the components numerically.

Note that each of first image data and second image data described in this specification is image data having a digital gray level. In the case where first image data is image data having an analog gray level, first image data input to the arithmetic device 102 may be input to the arithmetic device 102 after it is converted into image data having a digital gray level by an A/D converter.

Note that in this embodiment mode, image data of each frame is referred to as, for example, first image data of an $n^{th}$ frame (n is a natural number) and first image data of an $(n+1)^{th}$ frame. Note that one frame period is preferably set to about 1/60 second so that human eyes do not perceive flickers. Therefore, the number of frames for performing display (also referred to as a frame rate) is preferably set to about 60 frames for one second.

Note that the number of memories 108 provided in the first memory circuit portion 103 is preferably determined by the amount of first image data for one frame and the memory capacity of the memory 108. For example, in the case where the amount of the first image data for one frame is the same or substantially the same as the memory capacity of the memory 108, the number of memories 108 may be determined in accordance with the number of frames for the first image data. Note that in this case, in this embodiment mode, three memories 108 are provided in order to store first image data of an $(n-1)^{th}$ frame, first image data of an $n^{th}$ frame, and first image data of an $(n+1)^{th}$ frame. Note that in the case where the amount of the first image data for one frame is smaller than the memory capacity of the memory 108, one memory 108 may be provided in the first memory circuit portion 103 and first image data for a plurality of frames may be stored in the memory 108.

Figure 2:
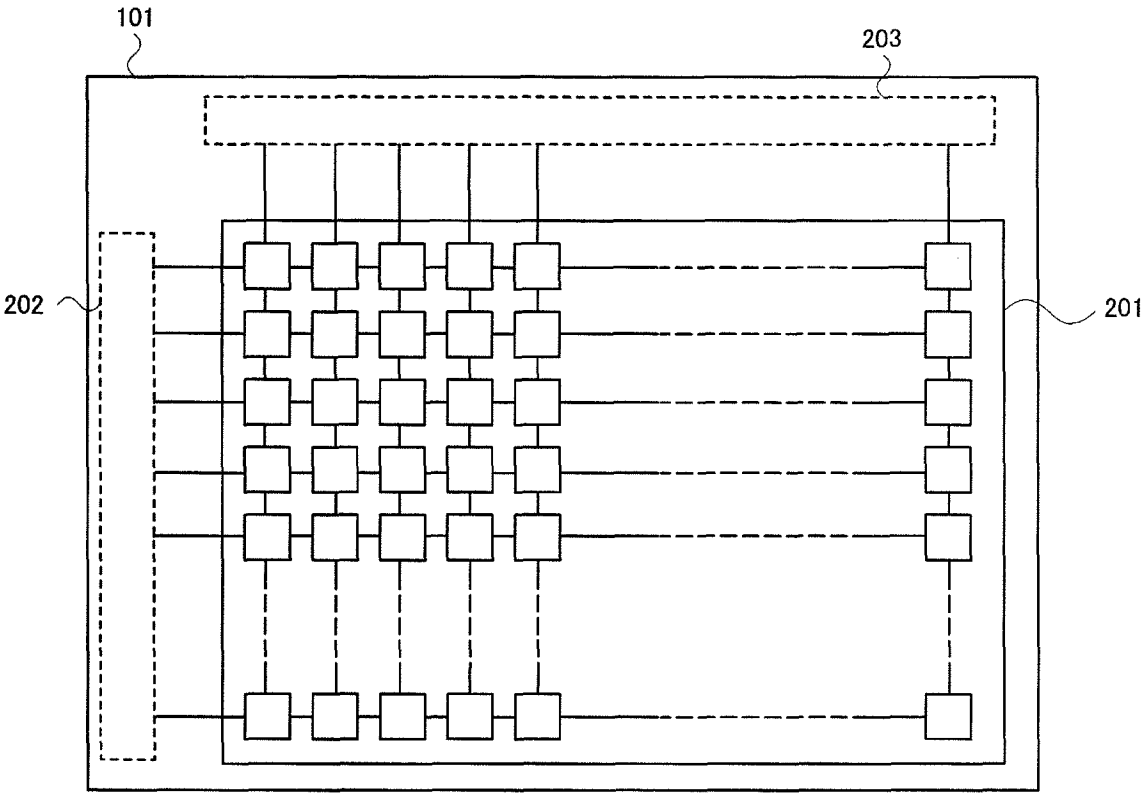
FIG. 2 is a diagram illustrating Embodiment Mode 1 of the present invention.

Note that the display panel 101 includes a display portion having a plurality of pixels, a scan line driver circuit, and a signal line driver circuit. FIG. 2 shows an example of the display panel 101. The display panel shown in FIG. 2 includes a display portion 201 having a plurality of pixels, a scan line driver circuit 202 for driving the plurality of pixels, and a signal line driver circuit 203 for supplying image data to the plurality of pixels. In addition, the plurality of pixels are arranged in m rows by n columns (m and n are natural numbers). Further, in the display portion 201, m pieces of wirings for controlling the operation of the pixels and n pieces of wirings for controlling the operation of the pixels extend from the scan line driver circuit 202 and the signal line driver circuit 203, respectively. Note that in FIG. 2, the plurality of pixels in the display portion 201 are represented with positions as follows: a pixel in a first row and a first column is represented as (1, 1); a pixel in the first row and a second column is represented as (1, 2); a pixel in the first row and an $n^{th}$ column is represented as (1, n); and a pixel in an $m^{th}$ row and the $n^{th}$ column is represented as (m, n). Note that in this embodiment mode, a given pixel in an $x^{th}$ row and a $y^{th}$ column is represented as (x, y), where x is a natural number larger than or equal to 1 and smaller than or equal to m and y is a natural number larger than or equal to 1 and smaller than or equal to n. Further, by selecting the position (x, y) of the pixel, procedure for all the pixels in the display portion 201 is performed.

The central processing unit 104 controls the reading control circuit 106 to read the first image data stored in the first memory circuit portion 103 and extracts a moving object region and a background region of a moving image displayed on the display panel 101. Note that the reading of the first image data from the first memory circuit portion 103 may be performed by, for example, providing a multiplexer (not shown) for reading the first image data in each frame from the plurality of memories 108 and controlling the multiplexer with the reading control circuit 105. In addition, the central processing unit 104 generates second image data of the $n^{th}$ frame, where the moving object region is displayed as a white image or a black image, based on the extracted moving object region and background region. The central processing unit 104 controls the reading control circuit 105 so that the generated second image data of the $n^{th}$ frame can be stored in a plurality of memories 109 included in the second memory circuit portion 107. Note that storing of the second image data is performed by providing a selector (not shown) for storing the second image data in each frame in the plurality of memories 109 and controlling the selector with the writing control circuit 105.

Note that the extraction of the moving object region and the background region is performed as follows, for example: a difference between the first image data of the $(n-1)^{th}$ frame and the first image data of the $n^{th}$ frame which are stored in the memory 108 in the first memory circuit portion 103 and a difference between the first image data of the $n^{th}$ frame and the first image data of the $(n+1)^{th}$ frame are calculated; the values of the calculated differences are compared to a given threshold value; and a logical AND of data based on the magnitude is calculated so that the moving object region and the background region can be extracted.

Note that a white image described in this embodiment mode refers to an image where the gray level of first image data which is to be input to a plurality of pixels included in a display panel is the highest gray level. Note that as a liquid crystal element, there are an element (hereinafter also referred to as a normally-black liquid crystal element) whose transmittance is 0% when a potential difference between two electrodes is 0 V (hereinafter referred to as a state where no voltage is applied) and an element (hereinafter also referred to as a normally-white liquid crystal element) whose transmittance is 100% when the potential difference between the two electrodes is in the state where no voltage is applied. Therefore, in the case where a white image has the highest gray level, a normally-black liquid crystal element may be used. Note that in the case of a normally-white liquid crystal element, a white image refers to an image which has the lowest gray level. Further, a black image described in this embodiment mode refers to an image where the gray level of the first image data which is to be input to the plurality of pixels included in the display panel is the lowest gray level in the case of a normally-black liquid crystal element. Note that in the case of a normally-white liquid crystal element, a black image refers to an image which has the highest gray level.

Note that although the case is briefly described in which algorithm by a P-tile method is used for processing for converting the first image data in this embodiment mode into the second image data having a white image or a black image, the present invention is not limited to this.

Note that a moving object region in this embodiment mode refers to a region occupied by a moving object in first image data of the $n^{th}$ frame when a moving image displayed on a display panel with the first image data of the $n^{th}$ frame and a moving image displayed on the display panel with the first image data of the $(n+1)^{th}$ frame are compared to each other. Further, a background region refers to a region other than the moving object region in first image data of the $n^{th}$ frame.

Furthermore, a difference of first image data between respective frames refers to a difference of gray levels between first image data with different frame numbers input to a plurality of pixels included in a display panel (hereinafter simply referred to as a difference). Moreover, for example, in the case of a color liquid crystal display device in which a plurality of pixels included in a display panel are formed using color elements of R (red), G (green), and B (blue), the minimum unit of an image is formed of three pixels of an R pixel, a G pixel, and a B pixel. By calculating a difference between first image data and data of the R pixel, a difference between first image data and data of the B pixel, and a difference between first image data and data of the G pixel and performing majority processing, the moving object region may be extracted with a combination of R, G, and B (hereinafter also referred to as a picture element), which is the minimum unit of an image. Note that colors other than R, G, and B may be used as the color elements. For example, the color elements may be formed using three pixels of yellow, cyan, and magenta.

The second memory circuit portion 107 includes a plurality of memories 109 for storing second image data generated by the extraction of the moving object region and the background region. Note that the number of the memories 109 provided in the second memory circuit portion 107 is preferably determined by the memory capacity of the memory 109, in a manner similar to that of the memory 108.

The second image data stored in the second memory circuit portion 107 is read by the reading control circuit 106 which is controlled by the central processing unit 104 and is inserted between the first image data of the $n^{th}$ frame and the first image data of the $(n+1)^{th}$ frame, which are stored in each of the memories 108 in the first memory circuit portion 103. That is, the reading control circuit 106 reads image data in order of the first image data of the $n^{th}$ frame, which is stored in the first memory circuit portion 103, the second image data of the $n^{th}$ frame, which is stored in the second memory circuit portion 107, and the first image data of the $(n+1)^{th}$ frame, which is stored in the first memory circuit portion 103. In other words, the first image data and the second image data are alternately output to the display panel in each frame. Note that the reading of the first image data and the second image data from the first memory circuit portion 103 and the second memory circuit portion 107 is performed by providing a multiplexer (not shown) for reading the first image data and the second image data in each frame from the plurality of memories 108 and 109 and controlling the multiplexer with the reading control circuit 105. The read first image data of the $n^{th}$ frame, which is stored in the first memory circuit portion 103, the read second image data of the $n^{th}$ frame, which is stored in the second memory circuit portion 107, and the read first image data of the $(n+1)^{th}$ frame, which is stored in the first memory circuit portion 103, are sequentially output to the display panel 101.

Note that by inserting the second image data of the $n^{th}$ frame between the first image data of the $n^{th}$ frame and the first image data of the $(n+1)^{th}$ frame, the length of one frame period for outputting the image data to the display panel is increased. Therefore, the central processing unit 104 preferably sets one frame period to about 1/120 second and alternately outputs the first image data and the second image data to the display panel. Thus, the number of frames for performing display is set to about 120 for one second. By inserting the second image data of the $n^{th}$ frame and increasing the frame rate, flickers when images are displayed on the display panel can be reduced, which is preferable. Note that one frame rate is not limited to 120 frames for one second. For example, one frame rate may be either 90 frames or 180 frames for one second.

Note that in this embodiment mode, by controlling the reading control circuit 106, the central processing unit 104 can generate the second image data from the first image data. Further, by controlling the writing control circuit 105 and the reading control circuit 106, the second image data is inserted between the first image data of the $n^{th}$ frame and the first image data of the $(n+1)^{th}$ frame so that the central processing unit 104 can supply the first image data into which the second image data is inserted to the display panel 101.

Furthermore, as the memory 108 and the memory 109 which are used in the first memory circuit portion 103 and the second memory circuit portion 107, there are a static memory (an SRAM), a dynamic memory (a DRAM), a ferroelectric memory (a FeRAM), an EEPROM, a flash memory, and the like, for example. Note that in the case of using a DRAM, it is necessary to add a regular refresh function.

Next, an example of extraction processing of a moving object region in the liquid crystal display device in FIG. 1 is described in detail with reference to a flow chart in FIG. 3.

Figure 3:
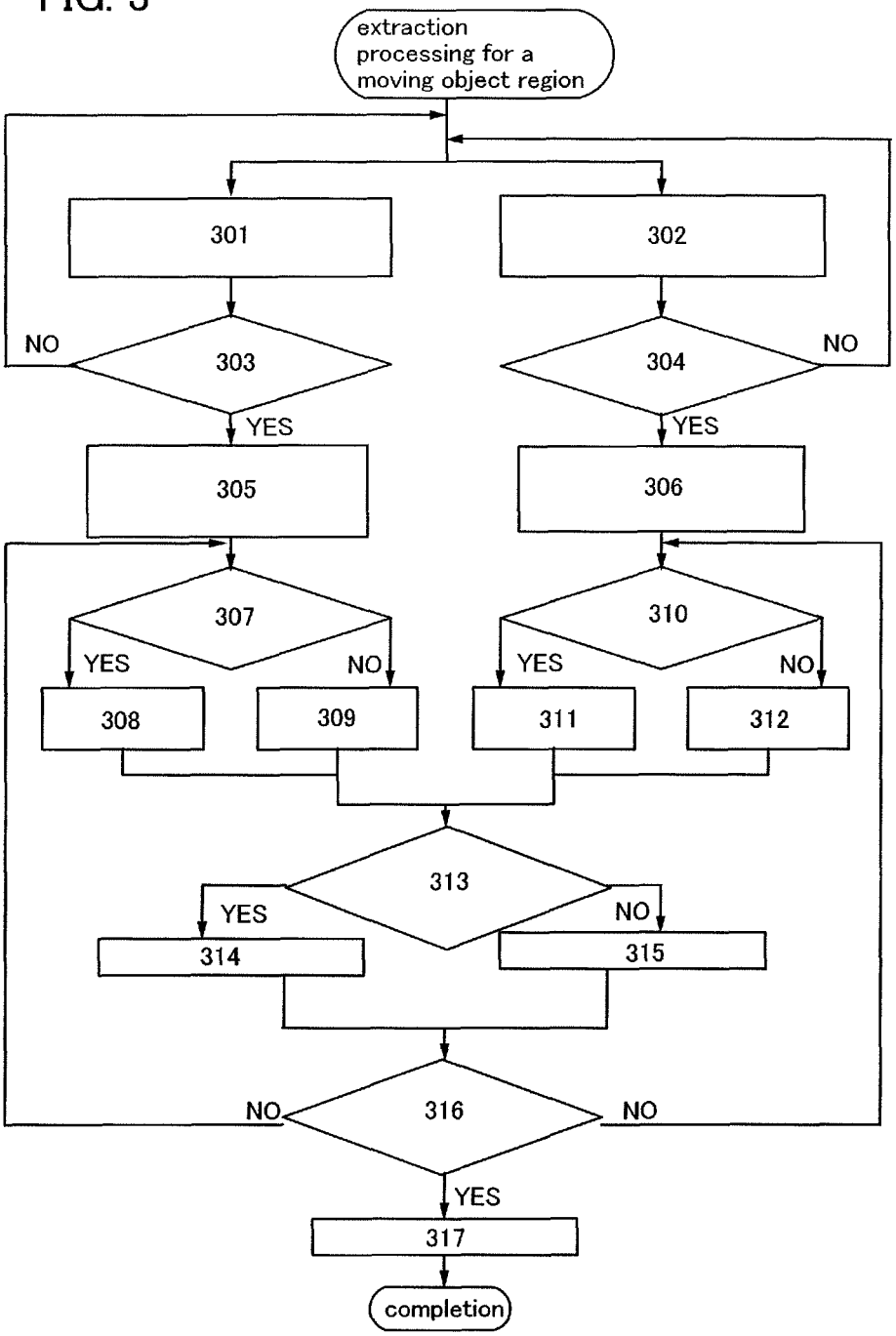
FIG. 3 is a flow chart illustrating Embodiment Mode 1 of the present invention.

FIG. 3 is a flow chart illustrating the extraction processing for a moving object region. The central processing unit 104 reads the first image data of the $(n-1)^{th}$ frame and the first image data of the $n^{th}$ frame, which are stored in the first memory circuit portion 103, and calculates the absolute value of a difference between the gray levels of each pixel (x, y) (Step 301). Further, for the first image data of the $n^{th}$ frame and the first image data of the $(n+1)^{th}$ frame, the central processing unit 104 calculates the absolute value of a difference between the gray levels of each pixel (x, y) (Step 302). The calculation of the absolute value of the difference between the gray levels of each pixel (x, y) in Step 301 and Step 302 is performed on all the pixels in the display panel 101 (Step 303 and Step 304).

Next, the central processing unit 104 converts the absolute value of the difference between the gray levels of each pixel, which is calculated in Step 303, into luminance of a given picture element (a combination of R, G, and B, which is the minimum unit of an image) (Step 305). Luminance here corresponds to a value which is obtained by performing weighting of respective colors of R, G, and B with respect to the absolute value of a difference between the gray levels of each pixel in one picture element. Specifically, with respect to luminance S, if a difference of the gray level of R is denoted by $R_G$; a difference of the gray level of G is denoted by $G_G$; and a difference of the gray level of B is denoted by $B_G$, $S=0.29891R_G+0.58661G_G+0.11448B_G$. In a similar manner, the central processing unit 104 converts the absolute value of the difference between the gray levels of each pixel, which is calculated in Step 304, into luminance of a given picture element (Step 306).

Next, the central processing unit 104 determines whether the luminance of the one picture element, which is converted in Step 305, is larger than or equal to a given threshold value (Step 307). When the luminance of the one picture element is larger than or equal to the threshold value in Step 307, a luminance determination value is 1 (Step 308). When the luminance of the one picture element is smaller than the threshold value in Step 307, a luminance determination value is 0 (Step 309). Further, the central processing unit 104 determines whether the luminance of the one picture element, which is converted in Step 306, is larger than or equal to a given threshold value (Step 310). When the luminance of the one picture element is larger than or equal to the threshold value in Step 310, a luminance determination value is 1 (Step 311). When the luminance of the one picture element is smaller than the threshold value in Step 310, a luminance determination value is 0 (Step 312).

Next, the central processing unit 104 determines whether the two luminance determination values obtained in Step 308 or 309 and Step 311 or 312 are both 1 (Step 313). When the two luminance determination values are both 1 in Step 313, a moving object determination value is 1 (Step 314). When the two luminance determination values are not both 1 in Step 313, a moving object determination value is 0 (Step 315). The central processing unit 104 determines whether the calculation of the moving object determination value, which is performed in Step 314 and Step 315, is performed in each picture element (Step 316). When the moving object determination values of all the picture elements are not obtained, processing is performed again from Step 307 and Step 310. In addition, when the calculation of the moving object determination value in each picture element is finished, regions whose moving object determination values are 1 are determined as moving object regions; regions whose moving object determination values are 0 are determined as background regions; and the extraction of the moving object regions is completed (Step 317).

Note that although Step 301 is performed in parallel with Step 302 in the flow chart shown in FIG. 3, Step 301 and Step 302 may be alternately performed.

Note that in FIG. 3, processing corresponding to each pixel in the display panel 101 is performed on the first image data of every frame in the flow chart for the extraction of moving objects. However, the first image data may be divided into a plurality of blocks; luminance is calculated in each divided block; and a difference is calculated based on the luminance so that the extraction of the moving objects can be performed. Note that the plurality of blocks are formed of any plurality of pixels included in the display panel, and luminance is calculated from the gray levels of the plurality of pixels included in the blocks.

Note that the threshold value which is to be compared to luminance in FIG. 3 may be obtained by calculating a luminance histogram from the first image data of every frame.

Next, an example of a method for generating second image data after the moving object region is extracted in the liquid crystal display device in FIG. 1 is described in detail with reference to a flow chart in FIG. 4.

Figure 4:
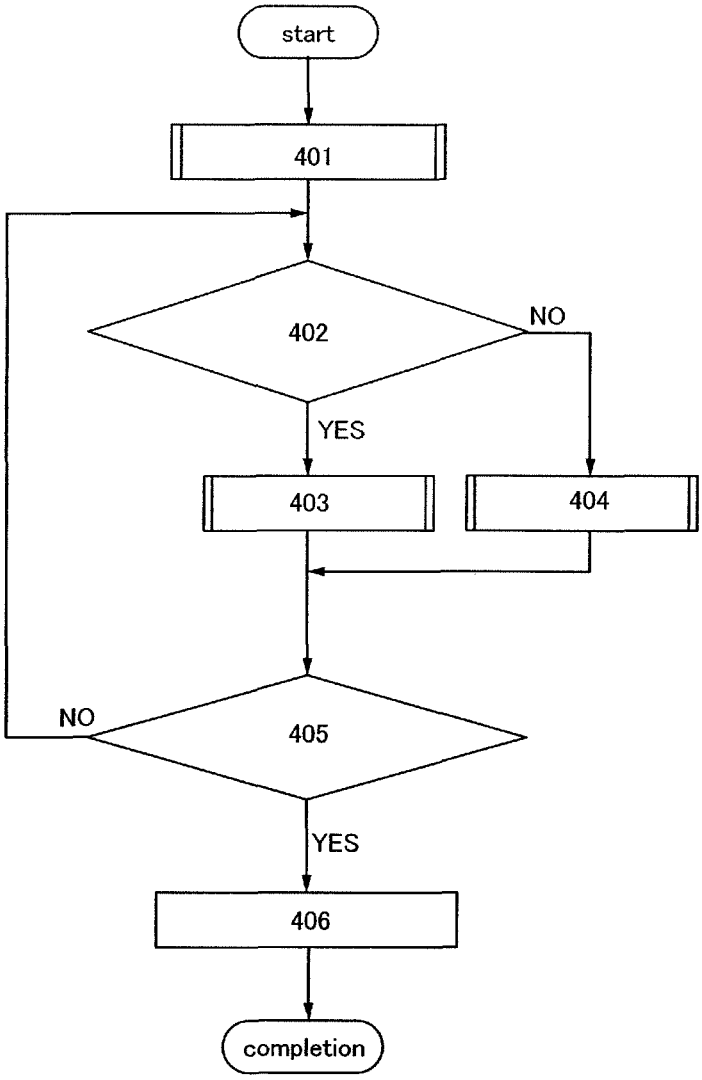
FIG. 4 is a flow chart illustrating Embodiment Mode 1 of the present invention.

FIG. 4 is a flow chart illustrating the extraction processing for a moving object region. After the moving object region is extracted, the central processing unit 104 starts processing for generating second image data (Step 401). The central processing unit 104 determines whether a selected picture element is a picture element of the moving object region in the first image data of the $n^{th}$ frame, which is obtained by the extraction of the moving objects (Step 402). When the selected picture element is a picture element of the moving object region, the central processing unit 104 converts the grayscale of pixels of R, G, and B included in the picture element in order to display a black image or a white image (Step 403). Alternatively, when the selected picture element is a picture element of the background region, the central processing unit 104 does not convert the grayscale of the pixels of R, G, and B included in the picture element (Step 404). The central processing unit 104 determines whether the grayscale conversion of each pixel in the moving object region in Step 402 to Step 404 is performed on all the picture elements in the display panel 101 (Step 405); and if there is a picture element which is not converted, processing is performed again from Step 402. When the conversion of the grayscale of the pixels of R, G, and B with respect to all the picture elements is finished, the central processing unit 104 completes the generation of the second image data.

Next, specific examples of display on the display panel in the liquid crystal display device of the present invention are described with reference to FIGS. 5A and 5B, FIG. 6, FIG. 7, and FIG. 8.

Figure 5A:
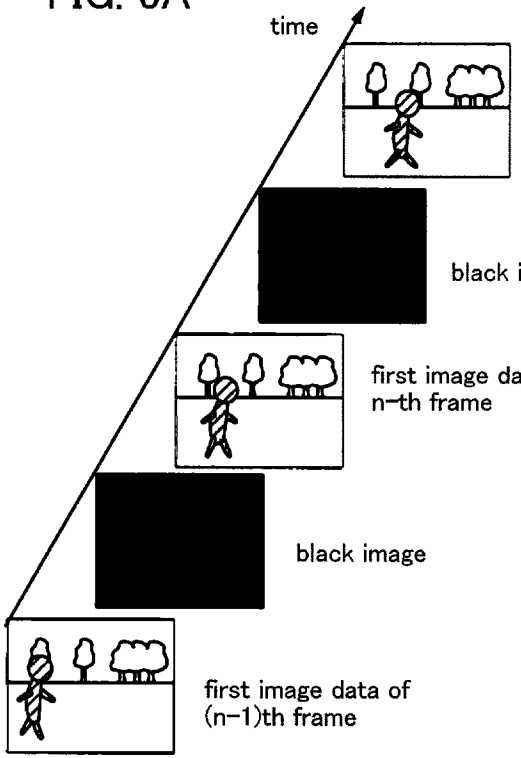
FIGS. 5A and 5B are diagrams illustrating Embodiment Mode 1 of the present invention.
Figure 5B:
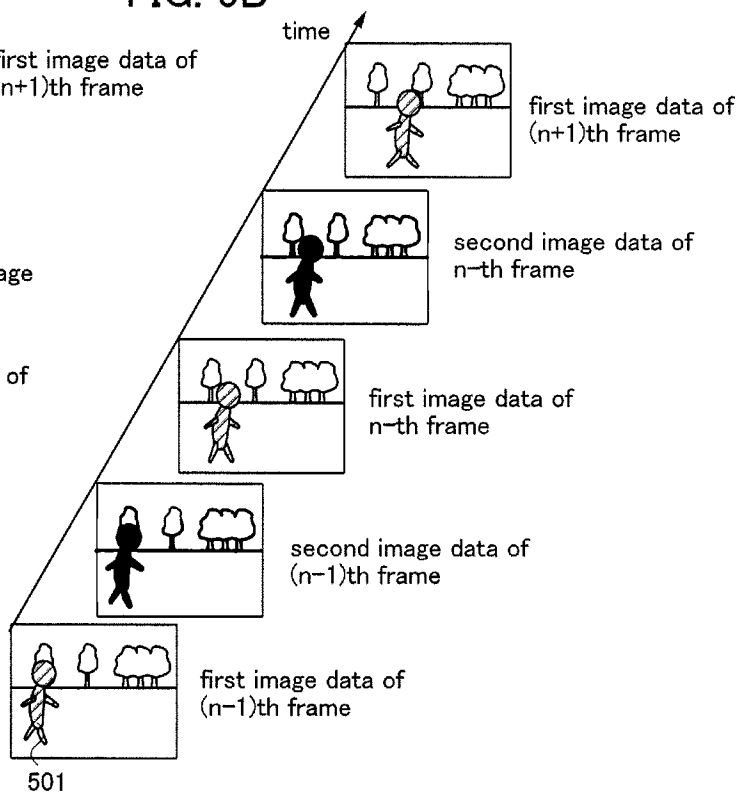

In conceptual diagrams of actual display on a display panel shown in FIGS. 5A and 5B, human-shaped regions on images are moving object regions whose positions are changed in accordance with frames; and regions other than the human-shaped regions are background regions whose positions are not changed in accordance with frames. Note that these diagrams are just examples for description and images which are to be displayed are not limited to them.

First, FIG. 5A shows change in an image displayed on the display panel over time when pseudo impulsive driving is performed by displaying a black image for a certain period in one frame period, which is described in the conventional example. FIG. 5A shows an example where the first image data of the $(n-1)^{th}$ frame, a black image, the first image data of the $n^{th}$ frame, a black image, and the first image data of the $(n+1)^{th}$ frame are sequentially displayed on the display panel. In FIG. 5A, in order to solve problems in that ghost edges are generated and that motion appears unnatural due to the response time of liquid crystal elements, a black image is inserted between respective frames of the first image data so that pseudo impulsive driving can be realized. Therefore, a black image in which nothing is displayed in one frame period is inserted, so that the contrast of a display screen is decreased. In the present invention, change in image data between the frames is focused; a moving object region and a background region are extracted; and only the moving object region, which is a region whose gray level is greatly changed among moving images, is converted into a black image. That is, in considering an example where a human-shaped image region is a moving object region (a human-shaped region 501 in FIG. 5B) as shown in FIG. 5B, display on the display panel is performed by generating the second image data of the $(n-1)^{th}$ frame, where the moving object region is displayed as a black image. In addition, FIG. 5B shows an example where the first image data of the $(n-1)^{th}$ frame, the second image data of the $(n-1)^{th}$ frame, the first image data of the $n^{th}$ frame, the second image data of the $n^{th}$ frame, and the first image data of the $(n+1)^{th}$ frame are sequentially displayed on the display panel. A region of a black image in the second image data of the $(n-1)^{th}$ frame corresponds to a moving object region of the first image data of the $(n-1)^{th}$ frame. A region of a black image in the second image data of the $n^{th}$ frame corresponds to a moving object region of the first image data of the $n^{th}$ frame. As shown in FIG. 5B, by inserting a black image for realizing pseudo impulsive driving by extracting a moving object region, the liquid crystal display device of the present invention can perform display on the display panel without decreasing the contrast of the second image data of the $(n-1)^{th}$ frame and the second image data of the $n^{th}$ frame, as compared to FIG. 5A in which a black image is displayed in all the pixels. That is, in the image displayed on the display panel, the smaller the area occupied by the moving object region becomes, the smaller the area of a region which is to be converted into a black image becomes; therefore, display can be performed with pseudo impulsive driving without decreasing the contrast. Note that it is particularly preferable to apply the present invention to a moving image where a moving object region and a background region can be extracted from the first image data.

Figure 6:
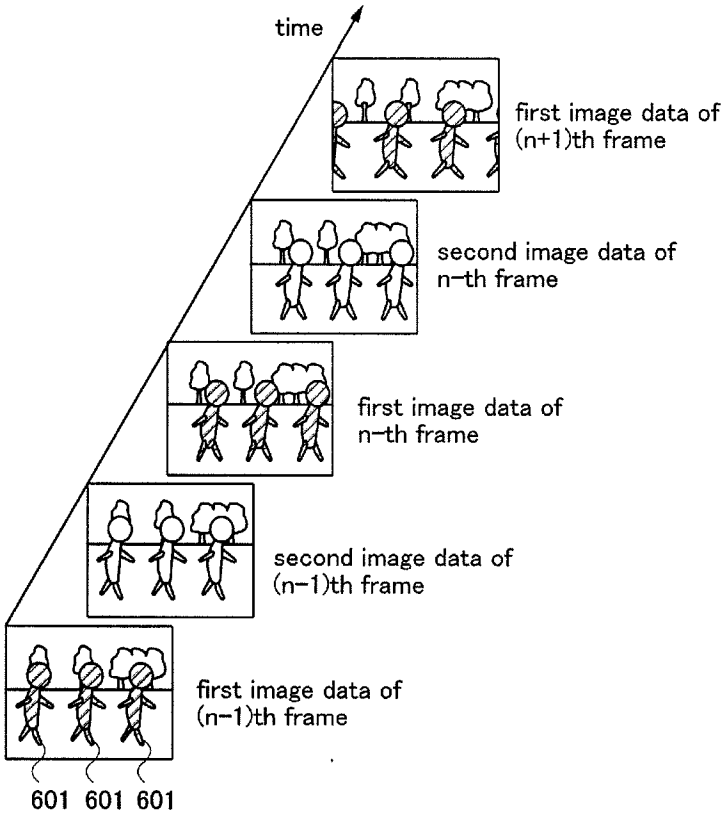
FIG. 6 is a diagram illustrating Embodiment Mode 1 of the present invention.

Further, in FIG. 5B, the case is described in which the human-shaped region 501 is shown as a moving object region and decrease in contrast of display on the display panel is prevented by generating the second image data which is displayed as a black image; however, depending on moving images, the moving object region occupies most portions of the display on the display panel in some cases. Thus, in the present invention, display on the display panel may be performed by generating the second image data of the $(n-1)^{th}$ frame and the second image data of the $n^{th}$ frame, where the moving object region is displayed as a white image. FIG. 6 shows an example of generating second image data, where the moving object region is displayed as a white image. FIG. 6 shows an example where the first image data of the $(n-1)^{th}$ frame, the second image data of the $(n-1)^{th}$ frame, the first image data of the $n^{th}$ frame, the second image data of the $n^{th}$ frame, and the first image data of the $(n+1)^{th}$ frame are sequentially displayed on the display panel, in a manner similar to that of FIG. 5B. In FIG. 6, a moving object region which is a region occupied by a human-shaped region 601 is larger than that of FIG. 5B. When a moving object becomes larger as shown in FIG. 6, a region of a black image, which is occupied in the second data, is eliminated by displaying the moving object region as a white image in advance, so that the contrast can be improved. In addition, as shown in FIG. 6, by inserting a white image for realizing pseudo impulsive driving by extracting a moving object region, display on the display panel can be performed without decreasing the contrast of the second image data of the $(n-1)^{th}$ frame and the second image data of the $n^{th}$ frame. Note that it is particularly preferable to apply the present invention to a moving image where a moving object region and a background region can be extracted.

Figure 7:
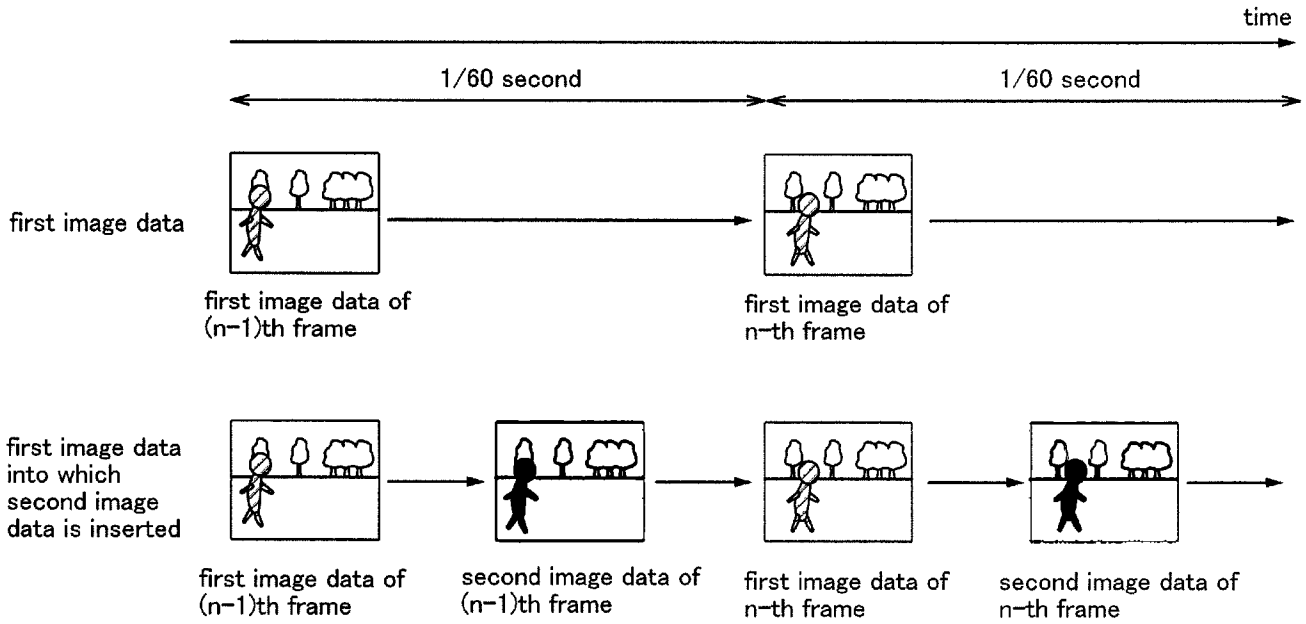
FIG. 7 is a diagram illustrating Embodiment Mode 1 of the present invention.

FIG. 7 shows an example where the first image data of the $(n-1)^{th}$ frame, the second image data of the $(n-1)^{th}$ frame, the first image data of the $n^{th}$ frame, and the second image data of the $n^{th}$ frame are sequentially displayed on the display panel. Note that a diagram shown in the upper part in FIG. 7 is a diagram used for describing the first image data before the second image data in the present invention is inserted; and a diagram shown in the lower part in FIG. 7 is a diagram used for describing the first image data into which the second image data in the present invention is inserted.

In FIG. 7, when the number of frames for the first data is 60 frames for one second, the first image data is switched at 1/60 second intervals as shown in FIG. 7 so that moving images are displayed on the display panel. Meanwhile, as for the first image data into which the second image data is inserted, a frame rate for displaying images is increased by the second image data generated by the extraction of the moving object region. Therefore, in the present invention, display on the display panel is preferably performed with 120 frames for one second, where the number of frames for the first image data is doubled, as shown in FIG. 7. By displaying the first image data into which the second image data is inserted with 120 frames for one second, flickers caused by the insertion of the second image data can be reduced.

Note that the present invention is not limited to the structure where the second image data is inserted into the first image data and the frame rate of the first image data is doubled, as described in FIG. 7. A different structure in the case where the second image data is inserted into the first image data is shown in FIG. 8.

Figure 8:
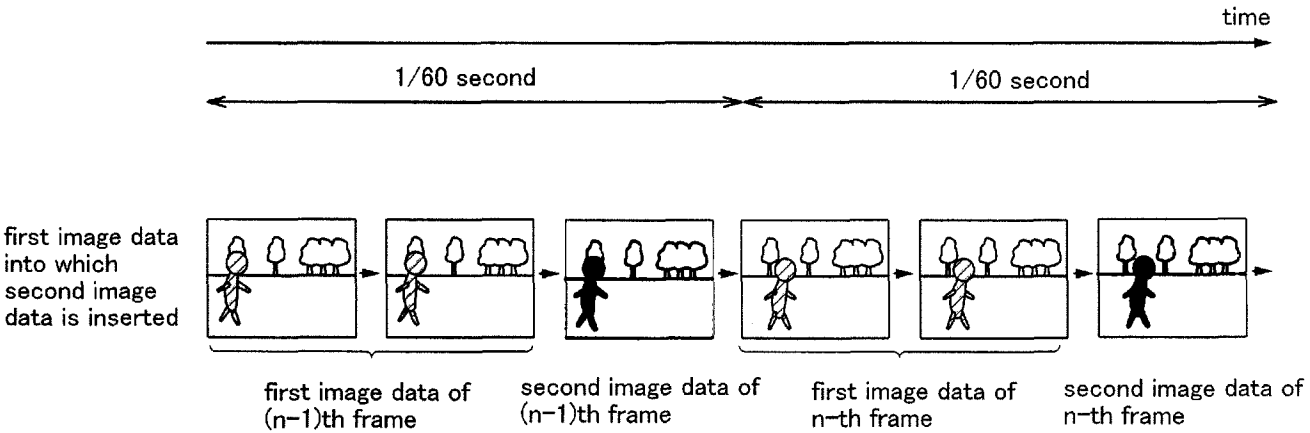
FIG. 8 is a diagram illustrating Embodiment Mode 1 of the present invention.

In FIG. 8, display on the display panel is preferably performed with 180 frames for one second, where the number of frames for the first image data is tripled. By displaying the first image data into which the second image data is inserted with 180 frames for one second, flickers caused by the insertion of the second image data can be reduced.

As described above, it is particularly preferable to apply the present invention to a moving image where a moving object region and a background region can be extracted. Further, by extracting the moving object region and the background region from the first image data which is input from the outside and by generating second image data into which a black image or a white image is selectively inserted, it is possible to provide a liquid crystal display device which can perform pseudo impulsive driving, ensures brightness of a screen, and improves the contrast of the screen.

This embodiment mode can be combined with any of other embodiments modes as appropriate.

Embodiment Mode 2

In Embodiment Mode 1, a liquid crystal display device which can perform pseudo impulsive driving and improves the contrast of a screen by extracting a moving object region and a background region from first image data and by generating second image data into which a black image is selectively inserted is described. In this embodiment mode, the case of performing gamma correction on first image data is described.

Gamma correction refers to correction for changing luminance nonlinearly when grayscale is changed. For example, even if luminance is increased linearly and proportionally, human eyes do not perceive luminance as being increased proportionally. As luminance becomes higher, human eyes do not easily perceive a luminance difference. Thus, in order that human eyes perceive a luminance difference, it is necessary to increase luminance considerably as grayscale is increased.

Meanwhile, when human eyes view moving images, there is a tendency that human eyes track moving object regions and do not track background regions. Therefore, by generating third image data which is obtained by performing gamma correction for emphasizing a bright portion and a dark portion on the first image data described in Embodiment Mode 1, human eyes can particularly perceive light and dark emphatically. Thus, there is an advantage that a third dimension can be obtained from the moving images. That is, in the first image data output to the display panel, which is described in Embodiment Mode 1, by performing display on the display panel with the third image data on which gamma correction is performed and the second image into which a black image is selectively inserted, which is described in Embodiment Mode 1, as well as an advantage that pseudo impulsive driving is performed in which brightness of a screen is ensured and the contrast of the screen is improved, there is an advantage that a third dimension can be obtained.

Figure 13:
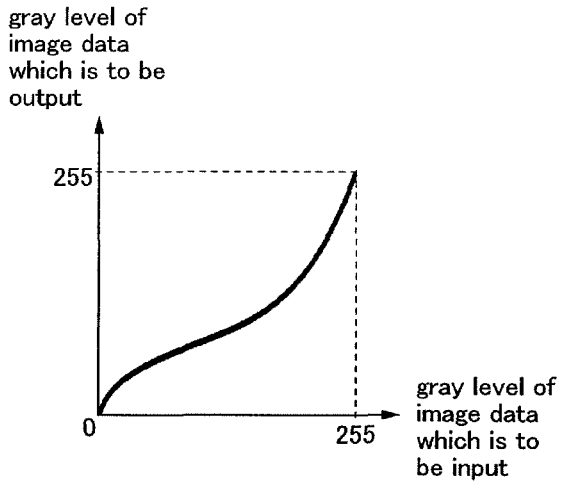
FIG. 13 is a graph illustrating Embodiment Mode 2 of the present invention.

Note that as for gamma correction in this embodiment mode, which is capable of obtaining a third dimension, a relationship between the gray level of image data which is to be input and the gray level of image data which is to be output is shown in FIG. 13. A curve of an input and output relationship by gamma correction shown in FIG. 13 is an inversely s-shaped curve. Note that an inverse s-shape refers to a shape which has an upward curved shape from low grayscale to intermediate grayscale and has a downward curved shape from the intermediate grayscale to high grayscale. When the curve of the input and output relationship by the gamma correction is an inversely s-shaped curve, the first image data on which gamma correction is performed can be corrected to have a gray level where a bright portion and a dark portion are emphasized. Note that in FIG. 13, an example is shown in which the highest level of the gray level of image data which is to be input and the gray level of image data which is to be output is 255.

Figure 14:
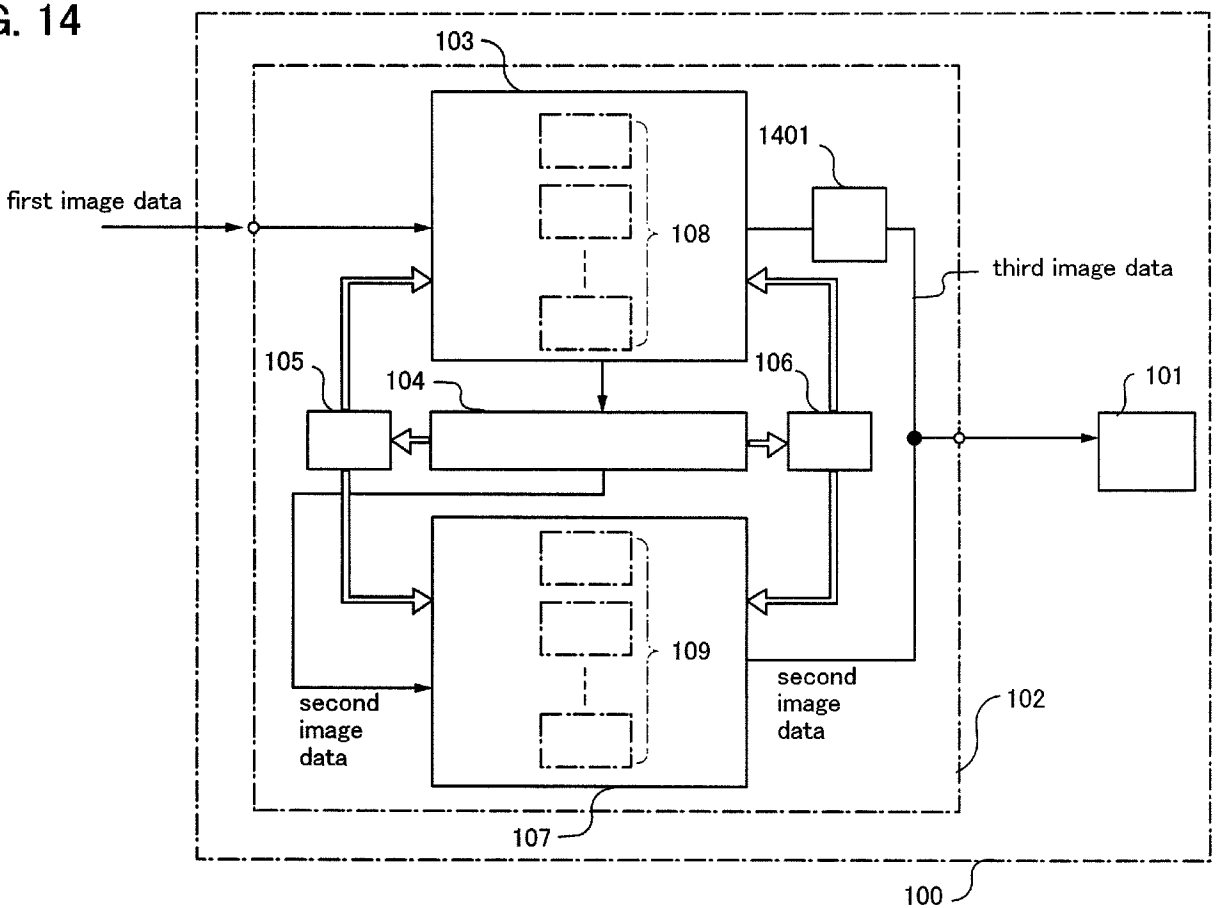
FIG. 14 is a block diagram illustrating Embodiment Mode 2 of the present invention.

Further, FIG. 14 is a block diagram for performing the gamma correction described in this embodiment mode in the liquid crystal display device described in Embodiment Mode 1. The liquid crystal display device 100 includes the display panel 101 and the arithmetic device 102. The arithmetic device 102 includes the first memory circuit portion 103, the central processing unit 104, the writing control circuit 105, the reading control circuit 106, the second memory circuit portion 107, and a gamma correction circuit 1401.

Since the structures other than the gamma correction circuit 1401 in the arithmetic device 102 shown in FIG. 14 are similar to those of FIG. 1, the description in Embodiment Mode 1 is used. In the gamma correction circuit shown in FIG. 14, gamma correction is performed on first image data which is output from the first memory circuit portion 103 so that the first image data is converted into third image data and is output to the display panel 101. Note that the third image data output from the gamma correction circuit 1401 and the second image data are alternately supplied to the display panel 101 in each frame in a manner similar to that of the first image data described in Embodiment Mode 1.

This embodiment mode can be combined with any of other embodiments modes as appropriate. That is, as described in Embodiment Mode 1, by extracting the moving object region and the background region from the first image data which is input from the outside and by generating second image data into which a black image is selectively inserted, it is possible to provide a liquid crystal display device which can perform pseudo impulsive driving, ensures brightness of a screen, and improves the contrast of the screen.

Embodiment Mode 3

Figure 9A:
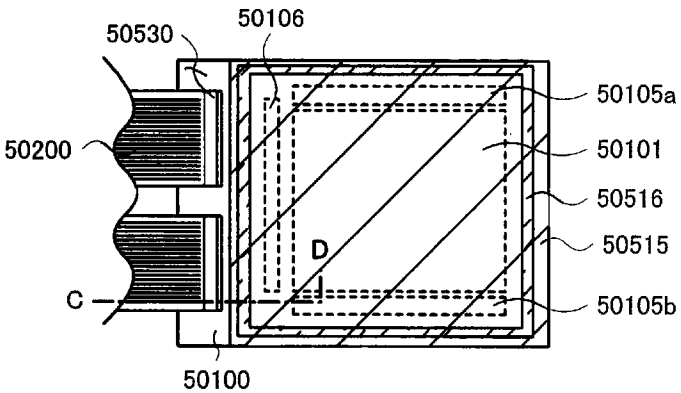
FIGS. 9A and 9B are a top view and a cross-sectional view illustrating Embodiment Mode 3 of the present invention.
Figure 9B:
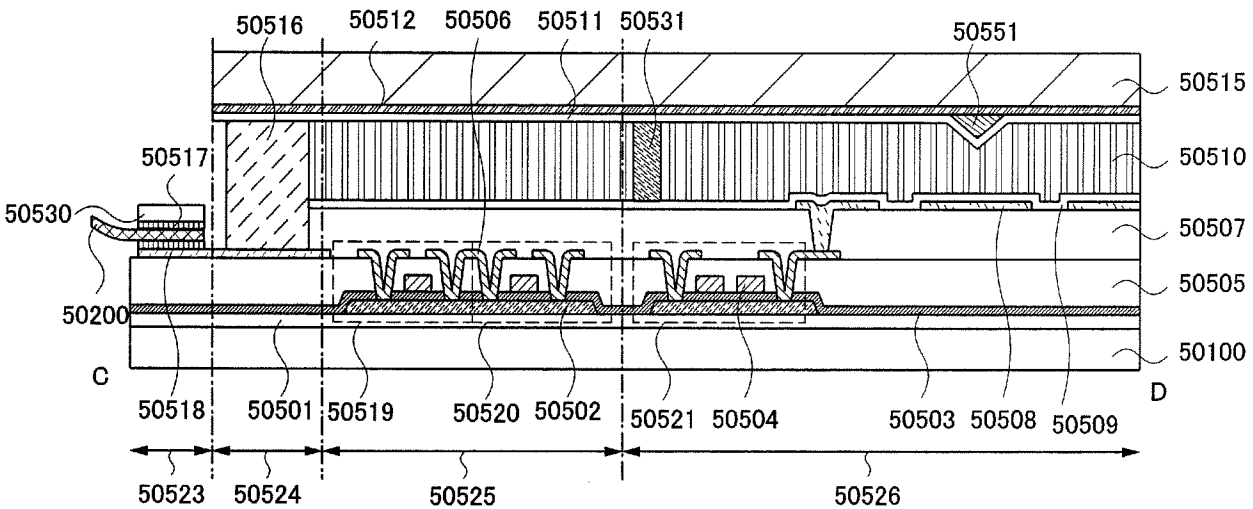

In this embodiment mode, the structure of a display panel in a liquid crystal display device of the present invention is described with reference to FIGS. 9A and 9B. Specifically, the structure of a liquid crystal display device which includes a TFT substrate, a counter substrate, and a liquid crystal layer held between the counter substrate and the TFT substrate is described. FIG. 9A is a top view of the liquid crystal display device. FIG. 9B is a cross-sectional view taken along line C-D in FIG. 9A. Note that FIG. 9B is a cross-sectional view of a top-gate transistor in the case where a crystalline semiconductor film (a polysilicon film) is formed over a substrate 50100 as a semiconductor film and a display mode is an MVA (multi-domain vertical alignment) mode.

As for the liquid crystal panel shown in FIG. 9A, a pixel portion 50101, a first scan line driver circuit 50105*a*, a second scan line driver circuit 50105*b*, and a signal line driver circuit 50106 are formed over a substrate 50100. The pixel portion 50101, the first scan line driver circuit 50105*a*, the second scan line driver circuit 50105*b*, and the signal line driver circuit 50106 are sealed between the substrate 50100 and a substrate 50515 with a sealant 50516. In addition, an FPC 50200 and an IC chip 50530 are provided over the substrate 50100 by TAB.

A cross-sectional structure taken along line C-D in FIG. 9A is described with reference to FIG. 9B. The pixel portion 50101 and peripheral driver circuit portions thereof (the first scan line driver circuit 50105*a*, the second scan line driver circuit 50105*b*, and the signal line driver circuit 50106) are formed over the substrate 50100. However, here, a driver circuit region 50525 (the second scan line driver circuit 50105*b*) and a pixel region 50526 (the pixel portion 50101) are shown.

First, an insulating film 50501 is deposited over the substrate 50100 as a base film. As the insulating film 50501, a single layer of an insulating film such as a silicon oxide film, a silicon nitride film, or a silicon oxynitride film ($SiO_xN_y$), or a stacked layer including at least two of these films is used. Note that a silicon oxide film is preferably used for part which is in contact with a semiconductor. Accordingly, an electron trap in the base film or hysteresis in transistor characteristics can be suppressed. Further, at least one film containing a large amount of nitrogen is preferably provided as the base film. Thus, the amount of impurities from glass can be reduced.

Next, a semiconductor film 50502 is formed over the insulating film 50501 by photolithography, an inkjet method, a printing method, or the like.

Next, an insulating film 50503 is formed over the semiconductor film 50502 as a gate insulating film. As the insulating film 50503, a single layer structure or a layered structure of a thermal oxide film, a silicon oxide film, a silicon nitride film, a silicon oxynitride film, or the like can be used. A silicon oxide film is preferably used as the insulating film 50503 which is in contact with the semiconductor film 50502. This is because a trap level at an interface between the insulating film and the semiconductor film 50502 can be lowered by using a silicon oxide film. Further, when a gate electrode is formed using Mo, it is preferable that the gate insulating film which is in contact with the gate electrode be a silicon nitride film. This is because Mo is not oxidized by a silicon nitride film. Here, as the insulating film 50503, a silicon oxynitride film (composition ratio: Si=32%, O=59%, N=7%, and H=2%) having a thickness of 115 nm is formed by plasma enhanced CVD.

Next, a conductive film 50504 is formed over the insulating film 50503 as a gate electrode by photolithography, an inkjet method, a printing method, or the like. As the conductive film 50504, Ti, Mo, Ta, Cr, W, Al, Nd, Cu, Ag, Au, Pt, Nb, Si, Zn, Fe, Ba, Ge, or the like; an alloy of any of these elements; or the like is used. Alternatively, a layered structure of any of these elements or an alloy thereof may be used. Here, the gate electrode is formed using Mo. Mo is preferable because it can be easily etched and is resistant to heat. Note that the semiconductor film 50502 is doped with an impurity element by using the conductive film 50504 or a resist as a mask to form a channel formation region and impurity regions which function as a source region and a drain region. Note that the impurity concentration in the impurity regions may be controlled to form a high-concentration impurity region and a low-concentration impurity region. Note that the conductive film 50504 in a transistor 50521 has a dual-gate structure. When the transistor 50521 has a dual-gate structure, the amount of off current of the transistor 50521 can be reduced. Note that a dual-gate structure refers to a structure having two gate electrodes. Note that a plurality of gate electrodes may be formed over the channel formation region in the transistor. Alternatively, the conductive film 50504 in the transistor 50521 may have a single-gate structure. Further, a transistor 50519 and a transistor 50520 can be manufactured in the same process as the transistor 50521.

As an interlayer film, an insulating film 50505 is formed over the insulating film 50503 and the conductive film 50504 formed over the insulating film 50503. As the insulating film 50505, an organic material, an inorganic material, or a layered structure thereof can be used. For example, the insulating film 50505 can be formed using a material selected from silicon oxide, silicon nitride, silicon oxynitride, silicon nitride oxide, aluminum nitride, aluminum oxynitride, aluminum nitride oxide containing more nitrogen than oxygen, aluminum oxide, diamond-like carbon (DLC), polysilazane, carbon containing nitrogen (CN), PSG (phosphosilicate glass), BPSG (borophosphosilicate glass), alumina, or other inorganic insulating materials. Alternatively, an organic insulating material may be used. An organic material may be either photosensitive or nonphotosensitive; and polyimide, acrylic, polyamide, polyimide amide, resist, benzocyclobutene, a siloxane resin, or the like can be used. Note that a siloxane resin corresponds to a resin containing a Si—O—Si bond. Siloxane has a skeleton structure formed by a bond of silicon (Si) and oxygen (O). As a substituent, an organic group (e.g., an alkyl group or aromatic hydrocarbon) or fluoro group may be used. The organic group may contain a fluoro group. Note that contact holes are selectively formed in the insulating film 50503 and the insulating film 50505. For example, a contact hole is formed over an upper surface of the impurity region of each transistor.

Next, conductive films 50506 are formed over the insulating film 50505 as a drain electrode, a source electrode, and a wiring by photolithography, an inkjet method, a printing method, or the like. As the conductive film 50506, Ti, Mo, Ta, Cr, W, Al, Nd, Cu, Ag, Au, Pt, Nb, Si, Zn, Fe, Ba, Ge, or the like; an alloy of any of these elements; or the like is used. Alternatively, a layered structure of any of these elements or an alloy thereof can be used. Note that in portions where contact holes are formed in the insulating film 50503 and the insulating film 50505, the conductive film 50506 and the impurity region of the semiconductor film 50502 of the transistor are connected to each other.

Next, an insulating film 50507 is formed as a planarization film over the insulating film 50505 and the conductive films 50506 formed over the insulating film 50505. Note that since the insulating film 50507 preferably has favorable flatness and coverage, it is often formed using an organic material. A multi-layer structure in which an organic material is formed over an inorganic material (e.g., silicon oxide, silicon nitride, or silicon oxynitride) may be used. Note that a contact hole is selectively formed in the insulating film 50507. For example, the contact hole is formed over an upper surface of a drain electrode of the transistor 50521.

Next, a conductive film 50508 is formed over the insulating film 50507 as a pixel electrode by photolithography, an inkjet method, a printing method, or the like. An opening portion is formed in the conductive film 50508. The opening portion formed in the conductive film 50508 can have the same function as a protrusion used in an MVA mode because the opening portion can make liquid crystal molecules be slanted. Note that as the conductive film 50508, a transparent electrode which transmits light can be used. For example, an indium tin oxide (ITO) film in which tin oxide is mixed in indium oxide, an indium tin silicon oxide (ITSO) film in which silicon oxide is mixed in indium tin oxide (ITO), an indium zinc oxide (IZO) film in which zinc oxide is mixed in indium oxide, a zinc oxide film, a tin oxide film, or the like can be used. Note that although IZO is a transparent conductive material formed by sputtering using a target in which zinc oxide (ZnO) is mixed in ITO at 2 to 20 wt. %, the present invention is not limited to this. In the case of a reflective electrode, Al, Ag, or the like; an alloy thereof; or the like can be used, for example. Alternatively, a two-layer structure in which Ti, Mo, Ta, Cr, or W and Al are stacked or a three-layer structure in which Al is interposed between metals such as Ti, Mo, Ta, Cr, and W may be used.

Next, an insulating film 50509 is formed as an alignment film over the insulating film 50507 and the conductive film 50508 formed over the insulating film 50507.

Next, the sealant 50516 is formed around the pixel portion 50101, or around the pixel portion 50101 and the peripheral driver circuit portions thereof by an inkjet method or the like.

Next, the substrate 50515 provided with a conductive film 50512, an insulating film 50511, a protrusion portion 50551, and the like and the substrate 50100 are attached to each other with a spacer 50531 interposed therebetween; and a liquid crystal layer 50510 is provided between the substrates. Note that the substrate 50515 functions as a counter substrate. In addition, the spacer 50531 may be formed by a method in which particles of several μm are dispersed or a method in which a resin film is formed over the entire surface of the substrate and then etched. Further, the conductive film 50512 functions as a counter electrode. As the conductive film 50512, a material similar to that of the conductive film 50508 can be used. Furthermore, the insulating film 50511 functions as an alignment film.

Next, the FPC 50200 is provided over the conductive film 50518 which is electrically connected to the pixel portion 50101 and the peripheral driver circuit portions thereof with an anisotropic conductive layer 50517 interposed therebetween. In addition, the IC chip 50530 is provided over the FPC 50200 with the anisotropic conductive layer 50517 interposed therebetween. That is, the FPC 50200, the anisotropic conductive layer 50517, and the IC chip 50530 are electrically connected to one another.

Note that the anisotropic conductive layer 50517 has a function of transmitting signals and potentials which are input from the FPC 50200 to pixels or peripheral circuits. As the anisotropic conductive layer 50517, a material similar to that of the conductive film 50506, a material similar to that of the conductive film 50504, a material similar to that of the impurity region of the semiconductor film 50502, or a film including two or more of the above may be used.

By forming a functional circuit (e.g., a memory or a buffer) in the IC chip 50530, the area of the substrate can be efficiently utilized.

Note that although the cross-sectional view in the case where the display mode is the MVA mode is described in FIG. 9B, the display mode may be a PVA (patterned vertical alignment) mode. In the case of using the PVA mode, a slit may be provided for the conductive film 50512 formed on the substrate 50515, so that liquid crystal molecules can be slanted to be aligned. In addition, a protrusion portion 50551 (also referred to as an alignment control protrusion) may be provided for the conductive film for which the slit is provided, so that liquid crystal molecules can be slanted to be aligned. Further, the display mode of liquid crystals is not limited to the MVA mode or the PVA mode; and a TN (twisted nematic) mode, an IPS (in-plane-switching) mode, an FFS (fringe field switching) mode, an ASM (axially symmetric aligned micro-cell) mode, an OCB (optical compensated birefringence) mode, an FLC (ferroelectric liquid crystal) mode, an AFLC (antiferroelectric liquid crystal) mode, or the like can be used.

Figure 10B:
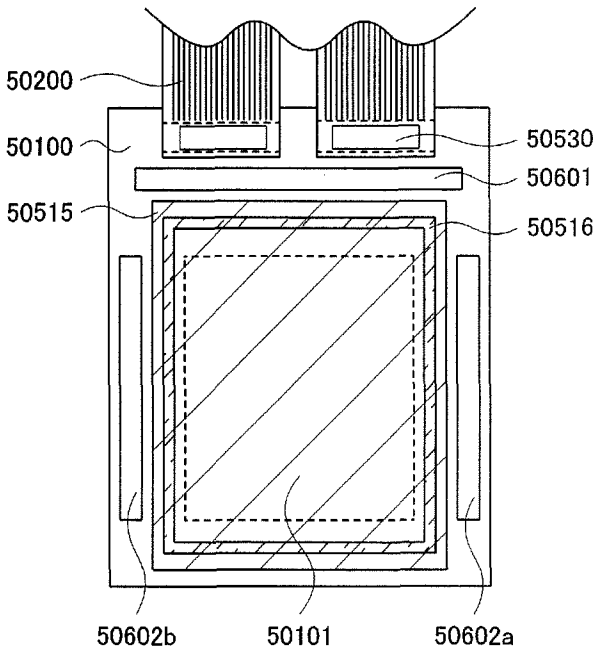
FIGS. 10A and 10B are top views illustrating Embodiment Mode 3 of the present invention.
Figure 10A:
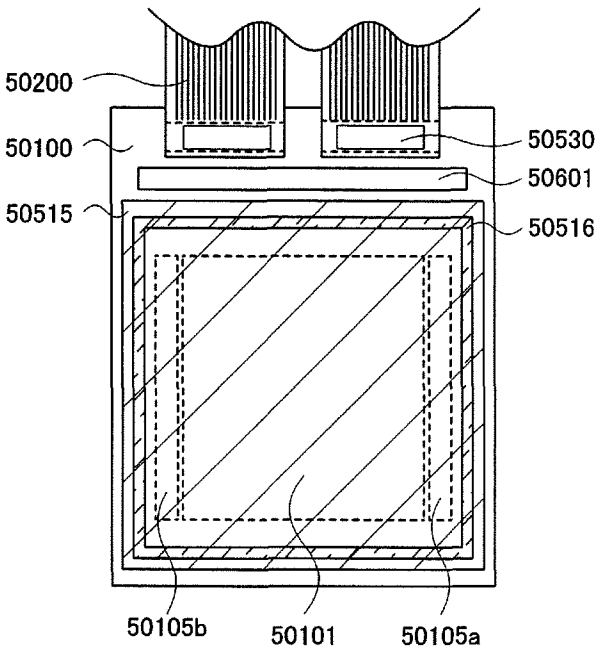

Although the structure is described in which the first scan line driver circuit 50105*a*, the second scan line driver circuit 50105*b*, and the signal line driver circuit 50106 are formed over the substrate 50100 in the liquid crystal panel in FIGS. 9A and 9B, a structure may be used in which a driver circuit corresponding to the signal line driver circuit 50106 is formed in a driver IC 50601 and is mounted on a liquid crystal panel by COG, as shown in a liquid crystal panel in FIG. 10A. By forming the signal line driver circuit 50106 in the driver IC 50601, power can be saved. In addition, by forming the driver IC 50601 as a semiconductor chip such as a silicon wafer, high speed operation and low power consumption of the liquid crystal panel in FIG. 10A can be achieved.

In a similar manner, as shown in a liquid crystal panel in FIG. 10B, a structure may be used in which driver circuits corresponding to the first scan line driver circuit 50105*a*, the second scan line driver circuit 50105*b*, and the signal line driver circuit 50106 may be formed in a driver IC 50602*a*, a driver IC 50602*b*, and a driver IC 50601, respectively, and are mounted on the liquid crystal panel by COG. In addition, by forming the driver circuits corresponding to the first scan line driver circuit 50105*a*, the second scan line driver circuit 50105*b*, and the signal line driver circuit 50106 in the driver IC 50602*a*, the driver IC 50602*b*, and the driver IC 50601, respectively, cost can be reduced.

This embodiment mode can be combined with any of other embodiments modes as appropriate. That is, as described in Embodiment Mode 1, by extracting the moving object region and the background region from the first image data which is input from the outside and by generating second image data into which a black image is selectively inserted, it is possible to provide a liquid crystal display device which can perform pseudo impulsive driving, ensures brightness of a screen, and improves the contrast of the screen.

Embodiment Mode 4

In this embodiment mode, examples of electronic devices are described.

Figure 11:
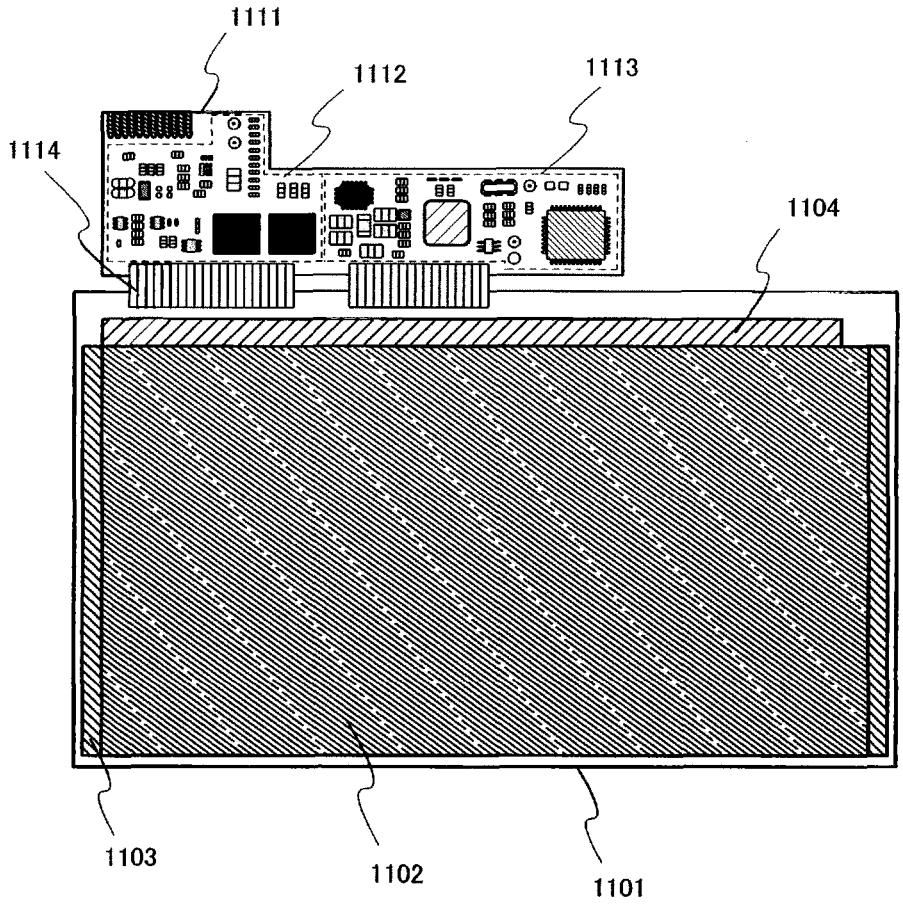
FIG. 11 is a diagram illustrating Embodiment Mode 4 of the present invention.

FIG. 11 shows a display panel module in which a display panel 1101 and a circuit board 1111 are combined with each other. The display panel 1101 includes a pixel portion 1102, a scan line driver circuit 1103, and a signal line driver circuit 1104. The circuit board 1111 includes a control circuit 1112, an arithmetic circuit 1113, and the like, for example. The display panel 1101 and the circuit board 1111 are connected to each other by a connection wiring 1114. An FPC or the like can be used as the connection wiring.

In the display panel 1101, the pixel portion 1102 and part of peripheral driver circuits (a driver circuit whose operation frequency is low among a plurality of driver circuits) may be formed over the same substrate by using transistors; and part of the peripheral driver circuits (a driver circuit whose operation frequency is high among the plurality of driver circuits) may be formed over an IC chip. The IC chip may be mounted on the display panel 1101 by COG (chip on glass) or the like. Thus, the area of the circuit board 1111 can be reduced, so that a smaller display device can be obtained. Alternatively, the IC chip may be mounted on the display panel 1101 by using TAB (tape automated bonding) or a printed wiring board. Thus, the area of the display panel 1101 can be reduced, so that a display device with a narrower frame can be obtained.

For example, in order to reduce power consumption, the pixel portion may be formed over a glass substrate by using transistors and all the peripheral driver circuits may be formed over an IC chip. Then, the IC chip may be mounted on the display panel by COG or TAB.

A television receiver can be completed with the display panel module shown in FIG. 11.

The content (or part of the content) described in each drawing in this embodiment mode can be applied to various electronic devices. Specifically, it can be applied to a display portion of an electronic device. As such electronic devices, there are cameras such as a video camera and a digital camera, a goggle-type display, a navigation system, an audio reproducing device (e.g., a car audio component or an audio component), a computer, a game machine, a portable information terminal (e.g., a mobile computer, a cellular phone, a portable game machine, or an e-book reader), an image reproducing device provided with a recording medium (specifically a device which reproduces the content of a recording medium such as a digital versatile disc (DVD) and has a display for displaying the reproduced image), and the like.

Figure 12A:
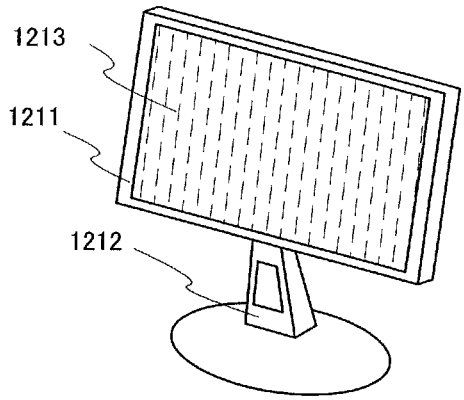
FIGS. 12A to 12C are diagrams illustrating Embodiment Mode 4 of the present invention.

FIG. 12A is a display, which include a housing 1211, a support base 1212, and a display portion 1213. The display shown in FIG. 12A has a function of displaying a variety of information (e.g., still images, moving images, and text images) on the display portion. Note that the display shown in FIG. 12A is not limited to having this function. The display shown in FIG. 12A can have various functions.

Figure 12B:
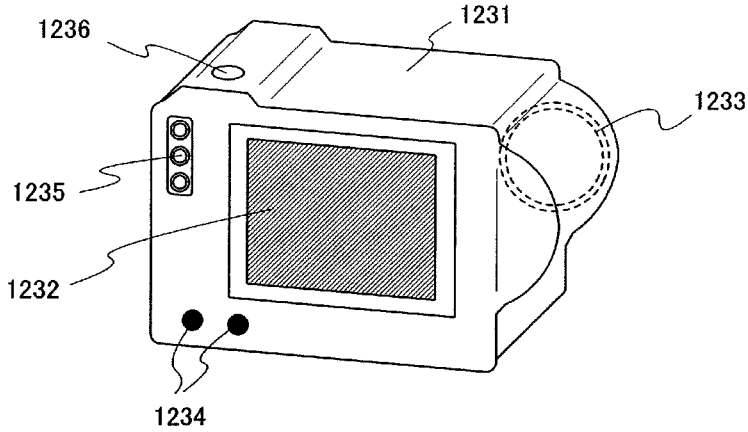

FIG. 12B shows a camera, which includes a main body 1231, a display portion 1232, an image receiving portion 1233, operation keys 1234, an external connection port 1235, and a shutter button 1236. The camera shown in FIG. 12B has a function of taking still images and a function of taking moving images. Note that the camera shown in FIG. 12B is not limited to having these functions. The camera shown in FIG. 12B can have various functions.

Figure 12C:
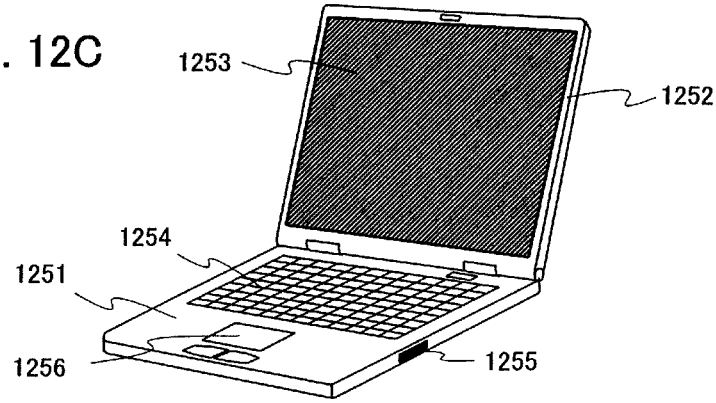

FIG. 12C shows a computer, which includes a main body 1251, a housing 1252, a display portion 1253, a keyboard 1254, an external connection port 1255, and a pointing device 1256. The computer shown in FIG. 12C has a function of displaying a variety of information (e.g., still images, moving images, and text images) on the display portion. Note that the computer shown in FIG. 12C is not limited to having this function. The computer shown in FIG. 12C can have various functions.

This embodiment mode can be combined with any of other embodiments modes as appropriate. That is, as described in Embodiment Mode 1, by extracting a moving object region and a background region with first image data which is input from the outside and by generating second image data into which a black image is selectively inserted, it is possible to provide an electronic device having a liquid crystal display device which can perform pseudo impulsive driving, ensures brightness of a screen, and improves the contrast of the screen.

This application is based on Japanese Patent Application serial no. 2007-300097 filed with Japan Patent Office on Nov. 20, 2007, the entire contents of which are hereby incorporated by reference.

EXPLANATION OF REFERENCE

100: liquid crystal display device, 101: display panel, 102: arithmetic circuit, 103: memory circuit portion, 104: central processing unit, 105: control circuit, 106: control circuit, 107: memory circuit portion, 108: memory, 109: memory, 201: display portion, 202: scan line driver circuit, 203: signal line driver circuit, 301: step, 302: step, 303: step, 304: step, 305: step, 306: step, 307: step, 308: step, 309: step, 310: step, 311: step, 312: step, 313: step, 314: step, 315: step, 316: step, 317: step, 401: step, 402: step, 403: step, 404: step, 405: step, 501: human-shaped region, 601: human-shaped region, 1101: display panel, 1102: pixel portion, 1103: scan line driver circuit, 1104: signal line driver circuit, 1111: circuit board, 1112: control circuit, 1113: arithmetic circuit, 1114: connection wiring, 1211: housing, 1212: support base, 1213: display portion, 1231: main body, 1232: display portion, 1233: image receiving portion, 1234: operation key, 1235: external connection port, 1236: shutter button, 1251: main body, 1252: housing, 1253: display portion, 1254: keyboard, 1255: external connection port, 1256: pointing device, 1401: gamma correction circuit, 50100: substrate, 50101: pixel portion, 50105*a*: first scan line driver circuit, 50105*b*: second scan line driver circuit, 50106: signal line driver circuit, 50200: FPC, 50501: insulating film, 50502: semiconductor film, 50503: insulating film, 50504: conductive film, 50505: insulating film, 50506: conductive film, 50507: insulating film, 50508: conductive film, 50509: insulating film, 50510: liquid crystal layer, 50511: insulating film, 50512: conductive film, 50515: substrate, 50516: sealant, 50517: anisotropic conductive layer, 50518: conductive film, 50519: transistor, 50520: transistor, 50521: transistor, 50525: driver circuit region, 50526: pixel region, 50530: IC chip, 50531: spacer, 50551: protrusion portion, 50601: driver IC, 50602*a*: driver IC, and 50602*b*: driver IC

The invention claimed is:

1. A liquid crystal display device, comprising:

a display panel including a plurality of pixels and;

an arithmetic device, wherein the arithmetic device is configured to extract a moving object region and a background region displayed on the display panel from first image data of an n-th frame, to generate second image data of the n-th frame where the moving object region is displayed as a black image or a white image, to insert the second image data between the first image data of the n-th frame and first image data of the (n+1)-th frame, and to output the first image data and the second image data to the display panel in the n-th frame, wherein the moving object region is displayed as the white image when the moving object region occupies most portions of the display panel.

2. The liquid crystal display device, according to claim 1, wherein only the moving object region is displayed as the black image or the white image.

3. A liquid crystal display device, comprising:

a display panel including a plurality of pixels and;

an arithmetic device including a first memory circuit portion, a central processing unit, and a second memory circuit portion, wherein the first memory circuit portion is configured to store first image data of an n-th frame, wherein the central processing unit is configured to extract a moving object region and a background region displayed on the display panel, from the first image data stored in the first memory circuit portion, and to generate second image data of the n-th frame where the moving object region is displayed as a black image or a white image, wherein the second memory circuit portion is configured to store the second image data, wherein the first image data stored in the first memory circuit portion and the second image data stored in the second memory circuit portion are to be output to the display panel in the n-th frame, wherein the arithmetic device is configured to insert the second image data between the first image data of the n-th frame and first image data of the (n+1)-th frame, and wherein the moving object region is displayed as the white image when the moving object region occupies most portions of the display panel.

4. The liquid crystal display device, according to claim 3, wherein only the moving object region is displayed as the black image or the white image.

5. A liquid crystal display device, comprising:

a display panel including a plurality of pixels and;

an arithmetic device including a first memory circuit portion, a central processing unit, a second memory circuit portion, a writing control circuit, and a reading control circuit, wherein the first memory circuit portion is configured to store first image data of an n-th frame, wherein the central processing unit is configured to extract a moving object region and a background region displayed on the display panel, from the first image data stored in the first memory circuit portion, and to generate second image data of the n-th frame where the moving object region is displayed as a black image or a white image, wherein the second memory circuit portion is configured to store the second image data, wherein the writing control circuit is configured to control writing of the first image data to the first memory circuit portion and writing of the second image data to the second memory circuit portion, wherein the reading control circuit is configured to control reading of the first image data from the first memory circuit portion and reading of the second image data from the second memory circuit portion, wherein the first image data stored in the first memory circuit portion and the second image data stored in the second memory circuit portion are to be output to the display panel in the n-th frame, wherein the arithmetic device is configured to insert the second image data between the first image data of the n-th frame and first image data of the (n+1)-th frame, and wherein the moving object region is displayed as the white image when the moving object region occupies most portions of the display panel.

6. The liquid crystal display device, according to claim 5, wherein only the moving object region is displayed as the black image or the white image.

7. An image display method of a liquid crystal display device for displaying a moving image on a display panel including a plurality of pixels, comprising the steps of:

extracting a moving object region and a background region displayed on the display panel from first image data of an n-th frame input to an arithmetic device, generating second image data of the n-th frame where the moving object region is displayed as a black image or a white image, and displaying the first image data and the second image data on the display panel in the n-th frame, the second image data being inserted between the first image data of the n-th frame and first image data of the (n+1)-th frame, and wherein the moving object region is displayed as the white image when the moving object region occupies most portions of the display panel.

8. The image display method of a liquid crystal display device, according to claim 7, wherein only the moving object region is displayed as the black image or the white image.

9. The image display method of a liquid crystal display device, according to claim 7, wherein a frame rate of the first image data and the second image data displayed on the display panel in the frame is higher than a frame rate of the first image data.

10. The liquid crystal display device, according to claim 1, wherein extraction of the moving object region and the background region is performed by calculating a difference between the first image data of the n-th frame and the first image data of the (n+1)-th frame.

11. The liquid crystal display device, according to claim 3, wherein extraction of the moving object region and the background region is performed by calculating a difference between the first image data of the n-th frame and the first image data of the (n+1)-th frame.

12. The liquid crystal display device, according to claim 5, wherein extraction of the moving object region and the background region is performed by calculating a difference between the first image data of the n-th frame and the first image data of the (n+1)-th frame.

13. The image display method of a liquid crystal display device, according to claim 7, wherein extraction of the moving object region and the background region is performed by calculating a difference between the first image data of the n-th frame and the first image data of the (n+1)-th frame.

14. The liquid crystal display device, according to claim 1, wherein extraction of the moving object region and the background region is performed by calculating a difference between the first image data of the n-th frame and the first image data of the (n+1)-th frame, and wherein the first image data of the n-th frame is inputted into the arithmetic device from the outside.

15. The liquid crystal display device, according to claim 3, wherein extraction of the moving object region and the background region is performed by calculating a difference between the first image data of the n-th frame and the first image data of the (n+1)-th frame, and wherein the first image data of the n-th frame is inputted into the arithmetic device from the outside.

16. The liquid crystal display device, according to claim 5, wherein extraction of the moving object region and the background region is performed by calculating a difference between the first image data of the n-th frame and the first image data of the (n+1)-th frame, and wherein the first image data of the n-th frame is inputted into the arithmetic device from the outside.

17. The image display method of a liquid crystal display device, according to claim 7, wherein extraction of the moving object region and the background region is performed by calculating a difference between the first image data of the n-th frame and the first image data of the (n+1)-th frame, and wherein the first image data of the n-th frame is inputted into the arithmetic device from the outside.

18. The liquid crystal display device, according to claim 1, wherein the moving object region is displayed as the black image when the moving object region occupies less than most portions of the display panel.

19. The liquid crystal display device, according to claim 3, wherein the moving object region is displayed as the black image when the moving object region occupies less than most portions of the display panel.

20. The liquid crystal display device, according to claim 5, wherein the moving object region is displayed as the black image when the moving object region occupies less than most portions of the display panel.

21. The liquid crystal display device, according to claim 7, wherein the moving object region is displayed as the black image when the moving object region occupies less than most portions of the display panel.

22. The liquid crystal display device, according to claim 1, wherein, when the moving object region is firstly displayed as the black image and becomes larger, it is then displayed as the white image.

23. The liquid crystal display device, according to claim 3, wherein, when the moving object region is firstly displayed as the black image and becomes larger, it is then displayed as the white image.

24. The liquid crystal display device, according to claim 5, wherein, when the moving object region is firstly displayed as the black image and becomes larger, it is then displayed as the white image.

25. The liquid crystal display device, according to claim 7, wherein, when the moving object region is firstly displayed as the black image and becomes larger, it is then displayed as the white image.

* * * * *